US006228105B1

(12) United States Patent
Johansen et al.

(10) Patent No.: US 6,228,105 B1
(45) Date of Patent: May 8, 2001

(54) FLEXIBLE PACIFIER

(75) Inventors: Jean L. Johansen; Brenda J. Meyers, both of Reedsburg, WI (US)

(73) Assignee: Gerber Products Company, Reedsburg, WI (US)

( * ) Notice: Subject to any disclaimer, the term of this patent is extended or adjusted under 35 U.S.C. 154(b) by 0 days.

(21) Appl. No.: 09/516,287

(22) Filed: Mar. 1, 2000

(51) Int. Cl.[7] ..... A61J 17/00
(52) U.S. Cl. ..... 606/234; 606/235; D24/197
(58) Field of Search ..... 606/239, 235, 606/236; D24/197, 196, 193, 45, 46; D1/102, 127

(56) References Cited

U.S. PATENT DOCUMENTS

| | | | | |
|---|---|---|---|---|
| D. 167,466 | | 8/1952 | Lobl | D83/8 |
| D. 237,222 | | 10/1975 | Moore | D24/4 |
| D. 237,554 | | 11/1975 | Hurst | D24/4 |
| D. 249,161 | | 8/1978 | Röhrig | D24/45 |
| D. 267,116 | | 11/1982 | Bubelis | D24/4 |
| D. 285,839 | | 9/1986 | Roehrig | D24/45 |
| D. 294,735 | * | 3/1988 | Morano et al. | D24/45 |
| D. 295,073 | * | 4/1988 | Ford | D24/45 |
| D. 338,274 | | 8/1993 | Chuang | D24/194 |
| D. 363,548 | | 10/1995 | Riccio-Disch et al. | D24/194 |
| D. 370,976 | * | 6/1996 | Lin | D24/194 |
| D. 376,014 | | 11/1996 | McKenney | D24/194 |
| D. 380,836 | | 7/1997 | Fitzpatrick et al. | D24/194 |
| D. 405,530 | | 2/1999 | Manganeillo et al. | D24/196 |
| D. 421,306 | * | 2/2000 | Meyers et al. | D24/197 |
| 990,662 | | 4/1911 | MacGlashan . | |
| 1,095,969 | | 5/1914 | Poore . | |
| 2,093,130 | | 9/1937 | Kurkjian | 128/252 |
| 2,503,505 | | 4/1950 | Middleton | 128/360 |
| 2,520,773 | | 8/1950 | Müller | 128/252 |
| 2,546,681 | | 3/1951 | Searer | 215/11 |
| 2,588,069 | | 3/1952 | Allen | 128/252 |
| 2,623,524 | | 12/1952 | Clemens | 128/252 |
| 2,707,470 | | 5/1955 | Greene | 128/252 |
| 2,803,251 | | 8/1957 | White | 128/252 |
| 2,889,829 | | 6/1959 | Tannenbaum et al. | 128/252 |
| 3,115,980 | | 12/1963 | De Woskin | 215/11 |
| 3,130,725 | | 4/1964 | Griesinger | 128/252 |
| 3,339,771 | | 9/1967 | Ballin | 215/11 |

(List continued on next page.)

FOREIGN PATENT DOCUMENTS

| | | |
|---|---|---|
| 1 287 253 | 1/1969 | (DE) . |
| 3316-824 | 11/1984 | (DE) . |
| 0 153 876 | 9/1985 | (EP) . |
| 621.677 | 5/1927 | (FR) . |
| 2 192 341 A | 1/1988 | (GB) . |
| WO 91/11982 | 8/1991 | (WO) . |
| WO 94/23686 | 10/1994 | (WO) . |

OTHER PUBLICATIONS

"Draft Drawings for a U.S. Design Patent Application" Jun. 17, 1999.

"Photographs of Pacifier Embodiment Consumer Tested on Apr. 14, 1998".

*Primary Examiner*—Henry J. Recla
*Assistant Examiner*—Lien Ngo
(74) *Attorney, Agent, or Firm*—Seidel Gonda Lavorgna & Monaco, PC

(57) ABSTRACT

An infant pacifier is provided including a nipple, a bond ring and a handle. The nipple has a shaft and a base, each made of a flexible membrane and formed integrally with one another. A rim is formed on the base of the nipple adjacent its outer periphery. The bond ring is generally planar and annular shape and engages the rim. The handle includes a mounting ring and an elongate grip located concentric with the mounting ring. The mounting ring engages the bond ring and the rim. The bond ring and the mounting ring are attached to the nipple, preferably by overmolding the nipple and bond ring to one another and sonic welding the handle to the nipple.

20 Claims, 2 Drawing Sheets

U.S. PATENT DOCUMENTS

| | | | |
|---|---|---|---|
| 3,481,500 | 12/1969 | Palma | 215/11 |
| 3,662,756 | 5/1972 | Hakim | 128/360 |
| 3,760,967 | 9/1973 | Welch et al. | 215/11 C |
| 3,825,014 | 7/1974 | Wroten | 128/360 |
| 3,886,996 | 6/1975 | Tseitlin et al. | 164/283 M |
| 4,329,996 | 5/1982 | Copeland | 128/359 |
| 4,402,321 | 9/1983 | Berg | 128/359 |
| 4,505,398 | 3/1985 | Kesselring | 215/11 B |
| 4,577,632 | 3/1986 | Grasset | 128/360 |
| 4,640,282 | 2/1987 | Careborg | 128/360 |
| 4,676,386 | 6/1987 | Phlaphongphanich | 215/11 |
| 4,688,571 | 8/1987 | Tesler | 128/360 |
| 4,768,510 | 9/1988 | Leung | 128/360 |
| 4,819,641 | 4/1989 | Russell et al. | 128/360 |
| 4,896,666 | 1/1990 | Hinkle | 128/202.13 |
| 5,004,473 | 4/1991 | Kalantar | 606/234 |
| 5,078,734 | 1/1992 | Noble | 606/236 |
| 5,129,532 | 7/1992 | Martin | 215/11.1 |
| 5,133,740 | 7/1992 | Kussick | 606/236 |
| 5,176,705 | 1/1993 | Noble | 606/236 |
| 5,178,291 | 1/1993 | Piercey | 215/11.1 |
| 5,211,656 | 5/1993 | Maddocks et al. | 606/236 |
| 5,292,335 | 3/1994 | Shin | 606/234 |
| 5,292,336 | 3/1994 | Spence, Jr. et al. | 606/236 |
| 5,342,398 | 8/1994 | Sun | 606/235 |
| 5,403,349 | 4/1995 | Röhrig | 606/234 |
| 5,454,835 * | 10/1995 | Wu | 606/235 |
| 5,474,028 | 12/1995 | Larson et al. | 119/71 |
| 5,512,047 | 4/1996 | Dvorak | 604/77 |
| 5,611,622 | 3/1997 | Wang | 374/151 |
| 5,700,279 | 12/1997 | Blando | 606/236 |
| 5,759,195 | 6/1998 | Fields et al. | 606/236 |
| 5,797,505 | 8/1998 | Kaura | 215/11.5 |
| 5,868,131 | 2/1999 | Murchie | 128/204.13 |
| 5,881,893 | 3/1999 | Manganiello | 215/11.5 |

* cited by examiner 20
10
18
12
24
28
26
22
48
50
34
36
32
40
46
14
52
42
56
44
38
16
54

20
10
18
12
24
26
28
22
48
34
50
36
32
40
46
14
16
52
42
38
56
44
54

FLEXIBLE PACIFIER

FIELD OF THE INVENTION

The present invention relates to pacifiers for infants.

BACKGROUND OF THE INVENTION

Many types of infant pacifiers are available. Generally, all pacifiers include a nipple on which and infant can suck and/or bite, a mouth shield for preventing the infant from ingesting the pacifier and a handle to give the infant or supervising adult a convenient structure for gripping the pacifier.

Pacifiers are either made of multiple components or formed as an integrated unit. Pacifiers made of components generally have a flexible nipple surrounded by a rigid mouth shield. The rigid mouth shield can be uncomfortable against an infant's face, particularly for the relatively long periods of time for which infants typically use the pacifier. The nipple of this type of pacifier typically passes through an aperture in the center of the mouth shield, creating a sharp corner, and sometimes a crevice, between the shield and the shaft of the nipple where saliva, dirt and the like can accumulate. It is sometimes difficult to keep this type of pacifier clean.

Integrally formed pacifiers are typically made of a plastic selected to provide the nipple with the desired flexibility and the mouth shield and handle with the necessary rigidity. Generally, the selection of plastic is governed by the need to provide a relatively rigid mount shield and handle. The nipple, therefore, is more rigid than desired. In addition, this type of pacifier typically has a sharp inside corner between the base of the nipple and the mouth shield that is difficult to clean.

Moreover, both the component and the integrally molded types of pacifiers have fixed nipples, which do not reciprocate as the infant alternatingly sucks and releases the nipple.

SUMMARY OF THE INVENTION

The present invention is directed to a pacifier comprising a nipple, a bond ring and a handle. The nipple includes a base and a shaft. The base comprises a membrane having an inner periphery, an outer periphery and a rim attached to the outer periphery of the membrane. The shaft has a tip at one end and is attached to the inner periphery of the membrane at the opposite end. The bond ring is attached to the rim and has an inner periphery defining an opening that is generally coextensive with the outer periphery of the membrane. The handle engages the bond ring and has a grip located inward from the inner periphery of the bond ring.

Another aspect of the present invention is directed to a process of forming a pacifier. A bond ring and a handle are provided, and a nipple is formed. The nipple includes a base having an outer periphery defining a rim that is adapted to engage the bond ring and the handle. The bond ring and rim are overmolded to one another, and the handle is attached to the rim.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE DRAWINGS

Figure 1:
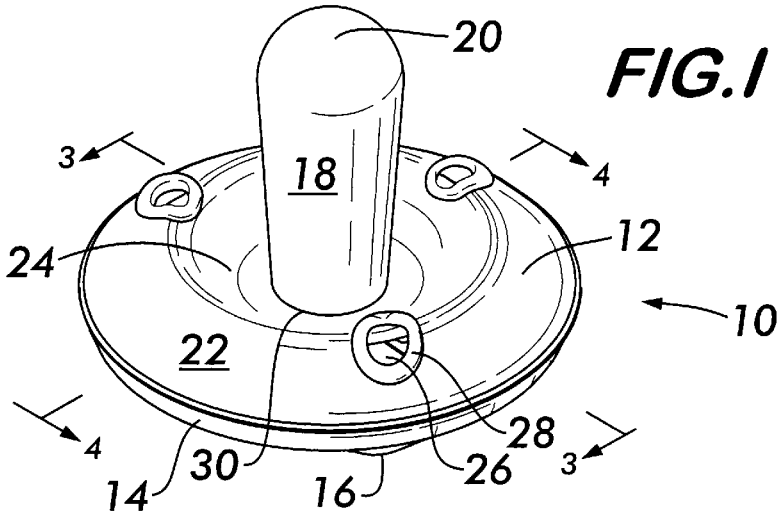
FIG. 1 is a perspective view of a pacifier according to the present invention.
Figure 2:
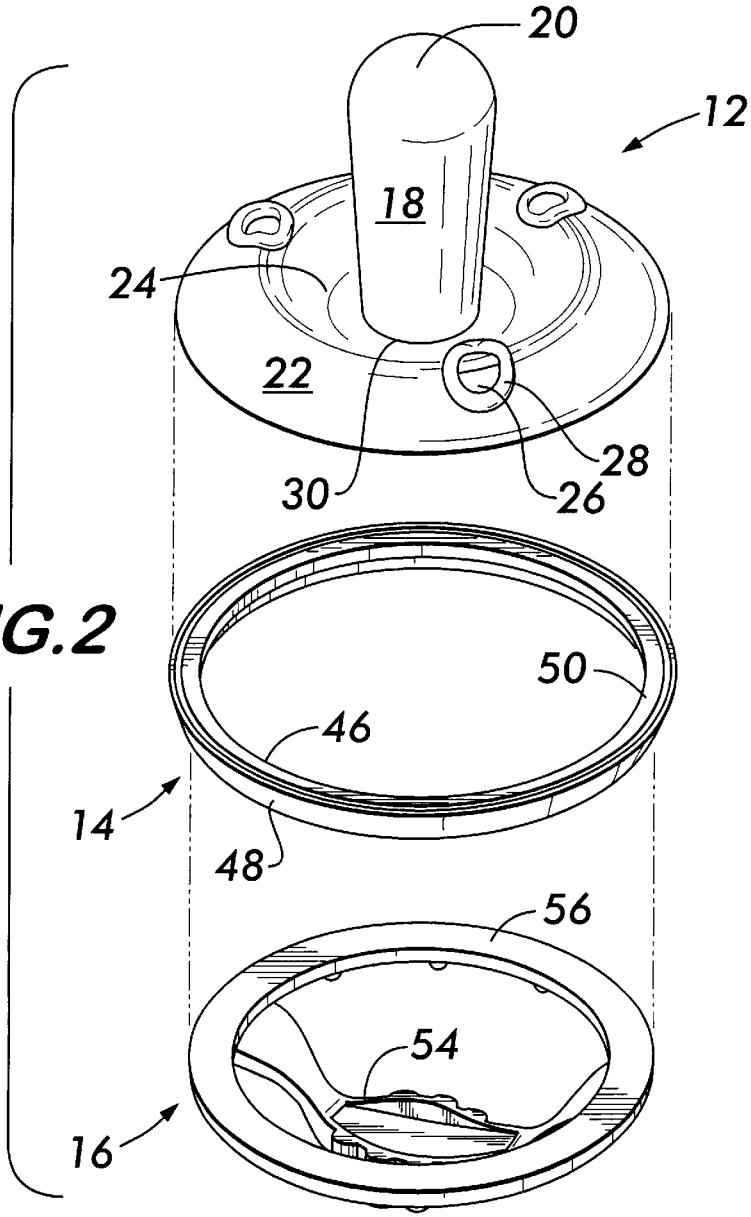
FIG. 2 is an exploded view of the pacifier illustrated in FIG. 1.
Figure 3:
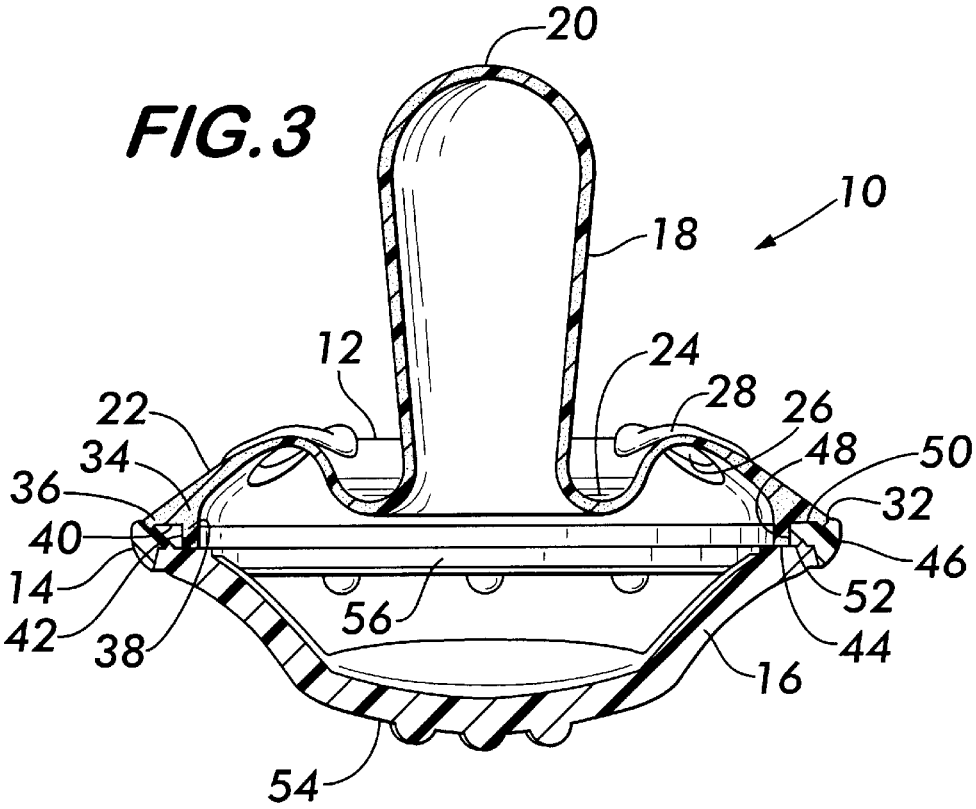
FIG. 3 is a sectional view of the pacifier as taken along line 3—3 of FIG. 1.
Figure 4:
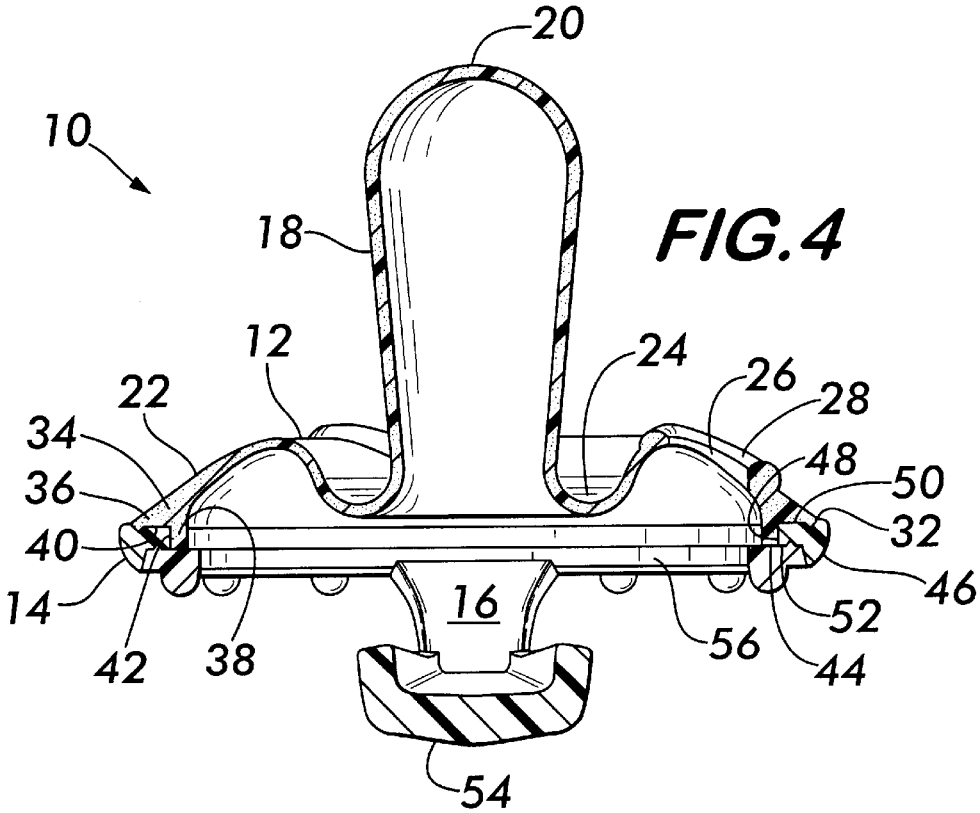
FIG. 4 is a sectional view of the pacifier as taken along line 4—4 of FIG. 1.

Referring to the drawings, wherein like numerals indicate like elements, FIGS. 1–4 illustrate a pacifier, which is generally denoted by the numeral 10. The pacifier 10 generally comprises a nipple 12, a bond ring 14 and a handle 16, which are designed for easy assembly, preferably by overmolding the nipple and bond ring to one another and sonic welding the handle to the bond ring.

The nipple 12 includes a shaft 18 having a tip 20 at one end and a base 22 at the opposite end. The shaft 18 preferably has a circular cross-sectional shape that tapers outward from the longitudinal axis of the nipple from the base 22 to the tip 20. The tip 20 is preferably generally hemispherical in shape. The shaft 18 is preferably made of a relatively soft material, such as an elastomer or the like. Although the shaft is shown as being a hollow tube, it may be solid. One skilled in the art will recognize that there are many shapes, sizes and compositions of nipples which may be used with a pacifier of the present invention.

The base 22 provides the pacifier 10 with a mouth shield and comprises a membrane of flexible material. The base 22 includes a generally semi-toroid shaped fold 24 that allows the shaft 18 to reciprocate along its longitudinal axis as an infant alternatingly sucks and releases it. The fold 24 is preferably concentric with the shaft 18, but need not be. For example, a cylindrical shaft may be surrounded by an elliptical fold. Similarly, an annular fold may be used with a shaft having an elliptical or other non-circular cross-sectional shape. Although a base having a generally concavo-convex shape is shown, it may have another shape such as planar. Moreover, the base may include more than one fold or none at all.

After use, the nipple 12 can be cleaned easily by pulling the shaft 18 out of the fold 24 such that the portion of the membrane that forms the fold 24 is made taught. In this position, the exterior of the shaft 18 and the side of the base 22 generally facing the tip 20 are easily accessed for cleaning.

Three apertures 26 are provided in the base 22 adjacent the fold 24. The apertures 26 provide ventilation for the portion of an infant's face that contacts the base 22 when the infant is using the pacifier 10. Each aperture 26 is defined by a flange 28 that is formed integrally with the base 22 and comprises a thickened region of the base 22. Although three apertures are shown, any number of apertures, or none at all, may be provided. In addition, the apertures may be located on the base anywhere desired. Moreover, the flanges that define the apertures may be separate components that are attached to the shield by adhesive, heat or chemical bonding, grommetting or the like. Alternatively, the apertures may be formed without flanges.

The base 22 has an inner periphery 30 and an outer periphery 32. The inner periphery 30 is attached to the shaft 18. The shaft 18 and base 22 are preferably formed integrally with one another and made of the same material. However, they may be formed separately from the same or different materials and joined to one another by heat bonding or the like. Preferably, the entire nipple 12 is made of a medical grade thermoplastic elastomer, such as KRATON® brand thermoplastic elastomer. (KRATON is a registered trademark of Shell Oil Company, Houston, Tex.) However, any suitable plastic, elastomer or the like may be used.

The base 22 has a rim 34 adjacent its outer periphery 32. The rim 34 includes a radial flange 36 and an annular skirt 38 that extends away from the base 22 in a direction opposite the shaft 18. The radial flange 36 and the skirt 38 define three contact surfaces 40, 42, 44 that are attached to the bond ring 14 and the handle as described below.

The bond ring 14 is generally annular in shape and provides stiffness for the flexible base 22 of the nipple 12 to prevent an infant from collapsing the base 22, which would allow a large portion or all of the pacifier to fit into the infant's mouth. The bond ring 14 has inner and outer peripheries 46, 48 that generally define its thickness and upper and lower surfaces 50, 52 that generally define its width. In the preferred embodiment, the thickness of the bond ring 14 is a generally small fraction of the diameter of its outer periphery 48. However, a bond ring 14 any suitable thickness may be used. To provide the necessary stiffness, the bond ring 14 is preferably made of a relatively stiff plastic, such as polyethylene or the like.

Although an annular bond ring is shown, it may have any regular or non-regular shape desired. For example, the bond ring may be shaped like an ellipse, a rectangle having rounded corners, a star, an outline of an animal or the like. Whichever shape is selected, it is preferred that the inner periphery of the bond ring be large enough to encompass at least one fold adjacent the base of the shaft and a plurality of ventilation apertures located adjacent the fold.

The upper surface 50 and inner periphery 46 of the bond ring 14 are attached to the rim 34, respectively, at the contact surfaces 40, 42. Although the preferred means of attaching the bond ring to the nipple is a bond produced by overmolding, other means, such as adhesive bonding, chemical bonding, heat welding or the like, may be used.

The handle 16 includes a generally elongate finger grip 54 and an annular mounting ring 56. The grip 54 is attached at its opposite ends to the mounting ring 56 at points that are generally diametrically opposed to one another. Preferably, the grip 54 is offset from the plane of the mounting ring 56, away from the lower surface 52 of the bond ring 14 to allow easier gripping of the finger grip 54 by an infant or an adult supervising an infant.

The grip 54 is preferably made of the same plastic as the bond ring 14 and integrally molded with the mounting ring 56. However, the grip may be made of any suitable material, such as hard or soft plastic, natural or synthetic elastomer or the like. The grip may also be a separate component from the mounting ring and attached thereto by adhesive bonding, chemical bonding, heat welding or the like.

In the preferred embodiment, the mounting ring 56 is attached to the contact surface 44 located at the bottom of the skirt 38. Preferably, the mounting ring 56 and the skirt 38 are sonic welded together along their entire lengths to create a continuous bond therebetween. However, the mounting ring alternatively may be attached to the bond ring and/or the rim by an adhesive, chemical welding, heat welding or the like. In an alternative embodiment, the mounting ring may be eliminated and the ends of the grip may be attached to the bond ring and/or the rim on the base of the nipple.

The presently preferred process of assembling the pacifier 10 shown in FIGS. 1–4 is to overmold the nipple 12 to the bond ring 14 and sonic weld the handle 16 to the nipple 12. First, the bond ring 14 and the handle 16 are pre-formed using an injection molding process. The bond ring 14 is inserted into press, wherein the shaft 18 and base 22 of the nipple 12 are formed and the rim 34 is overmolded to the bond ring 14. The handle 16 is attached to the rim 34 by sonic welding the mounting ring 56 to the rim 34 along their entire lengths.

Although the invention has been described and illustrated with respect to exemplary embodiments thereof, it should be understood by those skilled in the art that the foregoing and various other changes, omissions and additions may be made therein and thereto, without parting from the spirit and scope of the present invention.

We claim:

1. A pacifier comprising:

a nipple including a base and a shaft, the base comprising a membrane having an inner periphery, an outer periphery and a rim attached to the outer periphery of the membrane, the shaft having a tip at one end and being attached to the inner periphery of the membrane at the opposite end;

a bond ring attached to the rim and having an inner periphery defining an opening that is generally coextensive with the outer periphery of the membrane; and a handle engaging to the bond ring, the handle having a grip located inward from the inner periphery of the bond ring.

2. The pacifier of claim 1 wherein the membrane is flexible.

3. The pacifier of claim 2 wherein the membrane includes at least one fold adjacent the inner periphery of the membrane.

4. The pacifier of claim 1 wherein the bond ring has a generally planar, closed-curve-shape symmetrical about at least one axis that lies in a plane of the bond ring and passes through the center of the bond ring.

5. The pacifier of claim 4 wherein the bond ring is annular in shape and the shaft is concentrically located with respect to the bond ring.

6. The pacifier of claim 4 wherein the handle is generally elongate and is connected at opposite ends to the bond ring at end points of a line that connects diametrically opposed points on the bond ring.

7. The pacifier of claim 6 wherein the grip is located equidistant from opposite ends of the handle.

8. The pacifier of claim 2 further including a plurality of apertures within the membrane, the apertures being spaced apart from the inner and outer peripheries of the membrane.

9. The pacifier of claim 8 wherein each aperture is defined by a flange formed integrally with the membrane, the flange comprising a thickened region of the membrane.

10. The pacifier of claim 4 wherein the handle includes a mounting ring adapted to engage the bond ring.

11. A pacifier comprising:

a nipple including a shaft and a base, the shaft having a tip at one end, the base comprising a flexible membrane and a rim, the membrane having an inner periphery, an outer periphery and a fold located between the inner and outer peripheries, the shaft being attached at its end opposite the tip to the membrane at the inner periphery of the membrane;

a bond ring attached to the rim and having an upper surface and a lower surface, the bond ring being substantially planar and having a closed-curve-shape that is symmetrical about a line that connects two diametrically opposed points on the ring, the nipple extending away from the upper surface; and a handle engaging the lower surface of the bond ring, the handle having a grip located inward from the inner periphery of the bond ring.

12. The pacifier of claim 11 further including a plurality of apertures within the membrane, the apertures being spaced apart from the inner and outer peripheries of the membrane.

13. The pacifier of claim 12 wherein each aperture is defined by a flange formed integrally with the membrane, the flange comprising a thickened region of the membrane.

14. The pacifier of claim 11 wherein the membrane includes a fold adjacent the inner periphery of the membrane.

15. The pacifier of claim 14 wherein the fold is generally concentric with the shaft.

16. The pacifier of claim 11 wherein the handle includes a mounting ring adapted to mate with the bond ring, the mounting ring being attached to the bond ring along substantially the entire lengths of the mounting ring and the bond ring.

17. A pacifier comprising:

a nipple comprising a tubular shaft, the shaft being closed at one end and having an integrally formed base at the opposite end that comprises a generally arcuate flexible membrane having an outer periphery that forms a rim having a closed-curve ring shape that is symmetrical about at least one line that connects two diametrically opposed points on the rim, the membrane including a fold adjacent to and concentric with the shaft;

a bond ring having a ring shape similar to the rim and being attached to the rim along the entire lengths of the bond ring and the rim; and a generally elongate handle having a mounting ring and a grip, the mounting ring having ring-shape similar to the bond ring and rim and being attached to the bond ring and/or the rim along their entire lengths, the grip being generally concentric with the mounting ring and attached at opposite ends thereto at locations on the mounting ring that are generally diametrically opposite one another, the grip being spaced equidistant from the opposite ends and spaced apart from a plane defined by the bond ring in a direction opposite from the closed end of the shaft.

18. The pacifier of claim 17 further comprising a plurality of apertures located within the membrane adjacent the fold, each aperture being defined by a flange formed integrally with the membrane, the flange comprising a thickened region of the membrane.

19. A process of forming a pacifier comprising the steps of:

providing a bond ring;

providing a handle;

forming a nipple, the nipple including a base having an outer periphery defining a rim that is adapted to engage the bond ring and the handle;

overmolding the bond ring and the rim to one another; and attaching the handle to the rim.

20. The process of claim 19 wherein the handle comprises a grip and a mounting ring, the grip being located generally concentric with the mounting ring and attached thereto, the mounting ring being welded to the rim along substantially the entire length of the rim.

* * * * *